US007077244B2

(12) United States Patent
Oh et al.

(10) Patent No.: US 7,077,244 B2
(45) Date of Patent: Jul. 18, 2006

(54) ELEVATOR CAB LOCATING SYSTEM INCLUDING WIRELESS COMMUNICATION

(75) Inventors: Jae-Hyuk Oh, Tolland, CT (US); Alan M. Finn, Hebron, CT (US); Pei-Yuan Peng, Manchester, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/524,385

(22) PCT Filed: Oct. 8, 2002

(86) PCT No.: PCT/US02/32188

§ 371 (c)(1),
(2), (4) Date: Feb. 14, 2005

(87) PCT Pub. No.: WO2004/033352

PCT Pub. Date: Apr. 22, 2004

(65) Prior Publication Data

US 2005/0230193 A1 Oct. 20, 2005

(51) Int. Cl.
*B66B 1/34* (2006.01)

(52) U.S. Cl. ..... 187/394

(58) Field of Classification Search ..... 187/247, 187/248, 391–394, 413, 414
See application file for complete search history.

(56) References Cited

U.S. PATENT DOCUMENTS 3,414,088 A 12/1968 Burns et al.
4,134,476 A * 1/1979 Zolnerovich et al. ..... 187/394
4,375,057 A 2/1983 Weise et al.
4,674,604 A 6/1987 Williams
4,732,238 A 3/1988 Baumgartner
5,223,680 A 6/1993 Schmidt-Milikau et al.
5,306,882 A 4/1994 Gerwing et al.
5,677,519 A 10/1997 Herkel et al.
5,682,024 A 10/1997 Koopman, Jr. et al.
5,736,695 A 4/1998 Hoepken
5,831,227 A 11/1998 Finn et al.
5,883,345 A 3/1999 Schonauer et al.
5,889,239 A * 3/1999 Blackaby et al. ..... 187/391
6,079,521 A 6/2000 Schonauer et al.
6,305,503 B1 10/2001 Suzuki et al.

(Continued)

FOREIGN PATENT DOCUMENTS

EP 0 757 011 A2 2/1997
JP 02295866 A * 12/1990

OTHER PUBLICATIONS

Patent Cooperation Treaty International Search Report for International Application No. PCT/US02/32188, mailed Jun. 17, 2003.

(Continued)

*Primary Examiner*—Jonathan Salata
(74) *Attorney, Agent, or Firm*—Carlson, Gaskey & Olds

(57) ABSTRACT

An elevator system (20) includes wireless communicating portions (40, 42) that communicate with each other to provide elevator cab (22) position information within a hoistway (24). In one example, a first communicating portion (40) is supported on the elevator cab (22) that generates a radio frequency trigger signal (58) that is received by a second communicating portion (42) at a selected position along the hoistway (24). The second communicating portion (42) responsively generates an ultrasound signal (64) that is received by the first communicating portion (40). A characteristic of the received locating signal, such as the timing between the trigger signal and the receipt of the locating signal, provides position information regarding the cab within the hoistway.

14 Claims, 2 Drawing Sheets

U.S. PATENT DOCUMENTS

| | | | | |
|---|---|---|---|---|
| 6,446,761 | B1 * | 9/2002 | Motoyama et al. | 187/391 |
| 6,467,585 | B1 * | 10/2002 | Gozzo et al. | 187/391 |
| 6,554,107 | B1 | 4/2003 | Yumura et al. | |
| 6,601,679 | B1 * | 8/2003 | Crenella et al. | 187/395 |
| 2002/0014373 | A1 | 2/2002 | LaCarte | |
| 2005/0039987 | A1 * | 2/2005 | Redden | 187/394 |

OTHER PUBLICATIONS

Patent Cooperation Treaty International Search Report for International Application No. PCT/US02/32188, mailed Mar. 24, 2003.

* cited by examiner

ELEVATOR CAB LOCATING SYSTEM INCLUDING WIRELESS COMMUNICATION

TECHNICAL FIELD

This invention generally relates to elevator systems. More particularly, this invention relates to a locating system for determining the position of one or more elevator system components.

DESCRIPTION OF THE PRIOR ART

Elevator systems typically include a cab that moves within a hoistway between landings or different levels in a building, for example. A controller causes a machine to operate to move the elevator cab into a desired position in the hoistway, depending on the needs of a particular situation. Moving the cab accurately to a landing requires determining position information. Additionally, it is necessary to be able to determine the location of the cab within the hoistway at any time without having to move the cab to make the determination.

A variety of arrangements have been proposed or implemented for making elevator cab position determinations. Most such systems suffer from the drawback that they are expensive. Additionally, many such systems do not provide the desired level of accuracy over the lifetime of the system. Any system that requires periodic maintenance or servicing, introduces further additional, undesirable cost. Another difficulty associated with known systems is that they require a specialized hoistway or relatively extensive in-hoistway installation.

One example system uses encoders attached to the elevator motor, governor or one or more of the sheaves. Such arrangements do not always provide the desired accuracy because of slippage or mechanical wear in the associated components. Additionally, encoder-based systems require relatively complicated adjustment algorithms to compensate for differences between encoder readings and the actual position of the leveling zone where the cab should be placed at a landing. Another shortcoming of some such systems is that in the event of a power outage, it is not possible to immediately determine the location of the cab within the hoistway.

Other systems utilize vanes or other markers within the hoistway. Such arrangements introduce additional components, cost, materials and labor and do not necessarily provide the desired levels of accuracy.

While those skilled in the art are always striving to make improvements, there are additional challenges to be overcome. For example, previous attempts to use wireless signal transmission for position detection have suffered from accuracy problems, insufficient update rates and undesirably high cost. There is a need for a reliable, economical, accurate and efficient system for determining the position of an elevator cab within a hoistway. This invention meets that need in a unique manner and avoids the shortcomings and drawbacks of the prior art.

SUMMARY OF THE INVENTION

In general terms, this invention is a wireless communication arrangement for determining the position of an elevator cab within a hoistway. A first communicator portion is supported on the elevator cab. A second communicator portion is supported at a selected position in the hoistway. In most cases, a plurality of second communicating portions are strategically placed along the hoistway. Wireless communication indicating distances between the communicating portions provides information regarding the position of the elevator cab within the hoistway.

In one example system designed according to this invention, the first communicating portion comprises a first transceiver that is supported on the elevator cab. The first transceiver generates a trigger signal. The second communication portion comprises a second transceiver supported at a selected known position relative to the hoistway. The second transceiver generates a locating signal responsive to the trigger signal. The first transceiver receives the locating signal. A controller determines the location of the cab in the hoistway based upon a characteristic of the received locating signal.

In one example, the trigger signal is a radio frequency signal while the locating signal is an ultrasound signal. In one example, the time it takes for the ultrasound signal to be received by the first transceiver is the characteristic used to determine the location of the cab in the hoistway. The distance between the first and second transceivers and the known features of the ultrasound locating signal provide the relationship between the timing of the ultrasound signal receipt and the position of the elevator cab.

In one example, the first transceiver portion wirelessly communicates with a remotely located controller that makes the position determination. In another example, the first transceiver is hard wired to a controller that is programmed to make the position determination.

In one example, every landing along the hoistway has a door frame that supports a corresponding second transceiver. Advantageously, the second transceivers can be installed into the door frames prior to being delivered to the building site. In this manner, the position of the second transceivers relative to the hoistway can be economically and accurately controlled.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
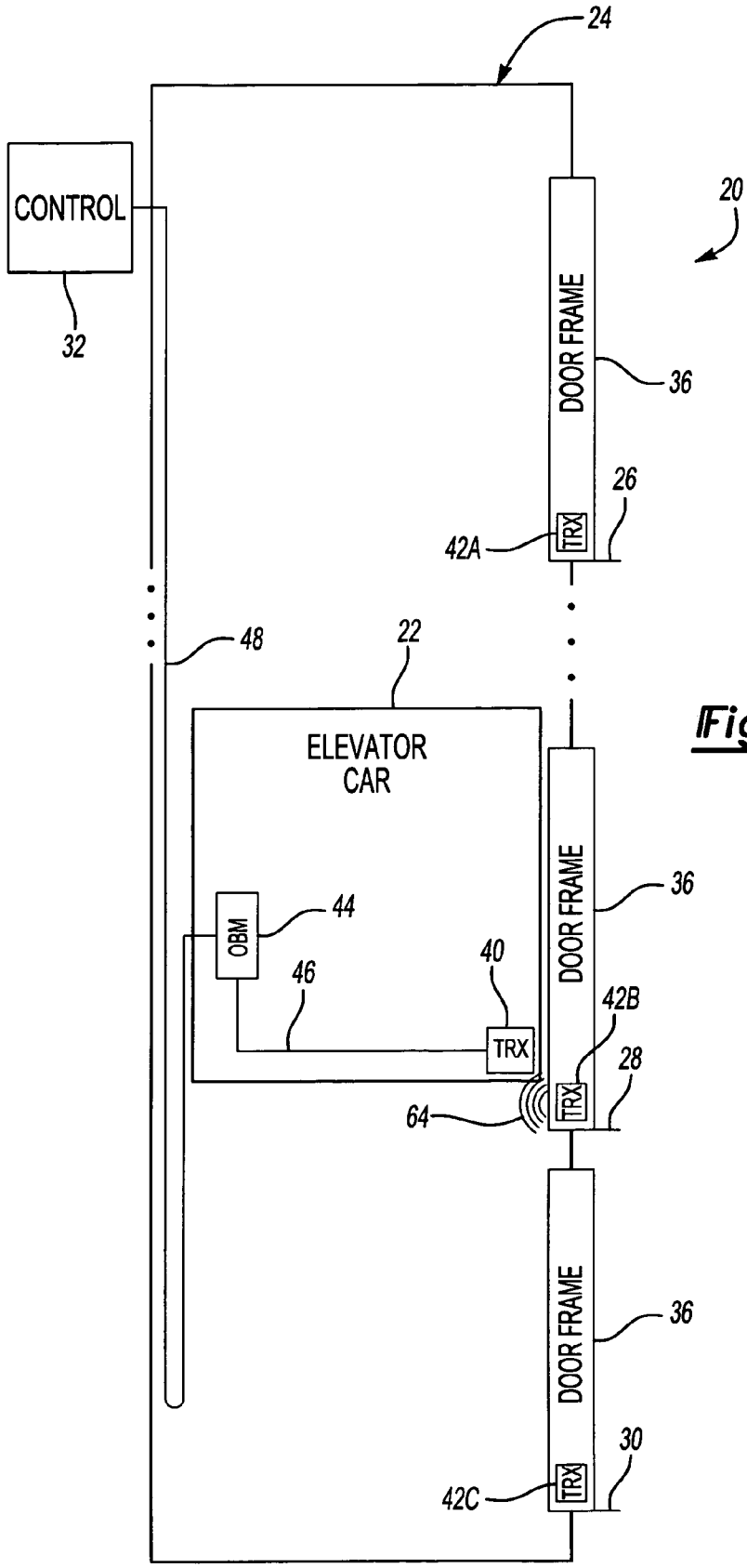
FIG. 1 schematically illustrates an elevator system including a position determining arrangement designed according to this invention.

FIG. 1 schematically shows an elevator system 20 where an elevator cab 22 moves within a hoistway 24 in a conventional manner. As known, the cab 22 preferably moves to various landings 26, 28 and 30 to allow transporting passengers or cargo between different levels within a building, for example.

A controller 32 controls a machine (not illustrated) that causes the desired movement of the elevator cab 22 within the hoistway 24. The cab 22 is supported within the hoistway 24 in a known manner using known components (not illustrated).

The controller 32 determines the location of the cab 22 within the hoistway 24 based upon information gathered by a first wireless communicating portion 40 that is supported for movement with the cab 22. The illustrated example schematically shows the communicating portion 40 mounted to the cab. Other locations, such as on associated brackets or cab-supporting structural members can be used.

A plurality of second communicating portions 42 are supported at selected positions along the hoistway 24 to provide cab position information as will be described below. In the illustrated example, each second communicating portion 42 is supported on a door frame 36 that comprises known components. One advantage of the inventive system is that the second communicating portions 42 can be installed into the door frames that are premade prior to being delivered to the building site where the elevator system 20 is installed. By previously installing the second communicating portions 42 in this manner, a variety of system economies can be realized. For example, the inventive arrangement does not require any hoistway modification or any special installation at the site where the elevator system is installed. The first communicating portion 40 can be preinstalled on the cab and the second communicating portions 42 can be preinstalled on the door frames.

In the illustrated example, the first communicating portion 40 is associated with an onboard module 44 on the elevator cab 22. A connection 46 is schematically shown in FIG. 1 to denote a power connection, communicating connection or both. In one example, the first communicating portion 40 is hardwired to the module 44 to receive power. In one example, communicating the signals indicating elevator cab position is also accomplished over a hardwire connection. In another example, communications between the first communicating portion 40 and the onboard module 44 are wireless.

The onboard module 44 is coupled through a conventional wire arrangement 48 for communications with the controller 32. In addition to the conventional communications between the electronics on the cab 22 and the controller 32, the inventive system provides elevator cab position information to the controller 32 as gathered from communications between the communicating portions 40 and 42.

Figure 2:
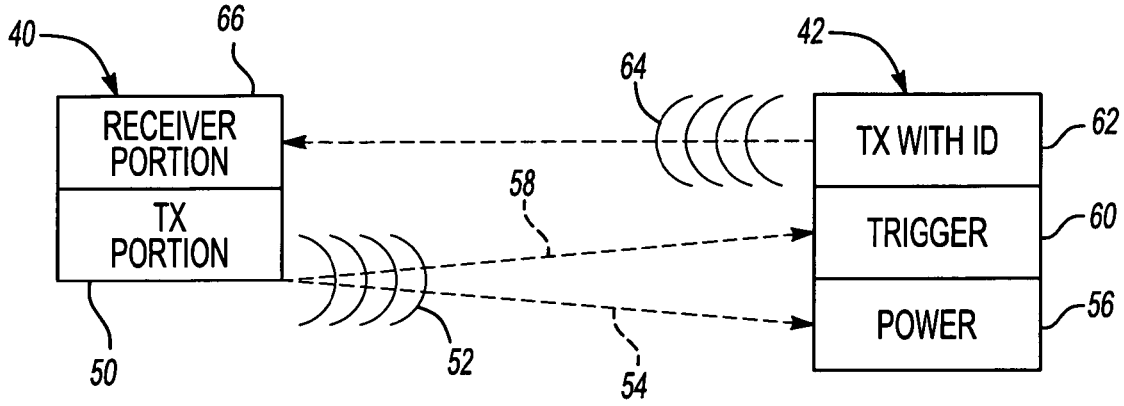
FIG. 2 schematically illustrates two communicating portions and wireless communication between them in an example system designed according to this invention.

FIG. 2 schematically illustrates an example communication strategy in a system designed according to this invention. The first communicating portion 40 comprises a transceiver that has a transmitter portion 50. In one example, the transmitter portion 50 generates a radio frequency communication signal 52 that is sent to the second communicating portion 42.

In the illustrated example, the radio frequency signal 52 has a first component 54 that is received by a power generator portion 56 of the second communicating portion 42. The power generator portion 56 preferably includes known components that receive the radio frequency signal and convert that into useable energy. In other examples, the second communicating portion 42 is powered by batteries, building power (hard-wired) or a combination of such known power sources.

A second component of the radio frequency signal 52 is a trigger signal 58 that is received by a trigger portion 60. The transmitter portion 50 generates the trigger signal 58 so that the second communicating portions 42 that are within a selected range of the cab 22 generate a locating signal responsive to the trigger signal 58. In this way, the example implementation of the inventive system limits the power consumption and signal generation from the second communicating portions 42 to only those that are within a selected vicinity of the elevator cab 22, which makes the example arrangement more efficient.

Based upon the trigger signal 58, the trigger portion 60 preferably causes a transmitter portion 62 of the second communicating portion 42 to generate a locating signal 64 that is received by a receiver portion 66 of the first communicating portion 40. In the illustrated example, each second communicating portion 42 has a unique identifier and the locating signal 64 preferably includes information corresponding to the identification of the component sending the signal. Referring to FIG. 1, for example, the second communicating portion 42A has a different identifier than that associated with 42B or 42C. A sufficiently large set of identifiers preferably is selected to ensure uniqueness.

In one example system designed according to this invention, the transmitter portion 62 sends multiple locating signals responsive to each trigger signal. In this example, the locating signals are combined to make the position determination. Such an arrangement has the advantage of increasing the signal-to-noise ratio, positioning accuracy or both.

The currently preferred embodiment includes an ultrasound transmitter as the transmitter portion 62. Accordingly, the locating signal 64 is an ultrasound signal that propagates at a known speed within the hoistway. Based upon the timing between the trigger signal 58 and the receipt of the locating signal by the receiver portion 66, the position of the first communicating portion 40 relative to the appropriate second communicating portion 42 can be determined. This position information also provides the position of the cab 22 within the hoistway because the location of the first communicating portion 40 onboard the cab 22 is known relative to the structure of the cab. In one example, additional system parameters such as cab velocity and local temperature are estimated from the locating signals 64 to improve the accuracy of the determined cab position.

Ultrasound is the preferred option because it is believed to provide the most accurate position determination. Other example types of electromagnetic energy may be used in a system designed according to this invention such as radio frequency signals, microwave signals, infrared signals, ultraviolet or visible light transmissions. Those skilled in the art who have the benefit of this description will be able to select the type of signals and modulation strategy that will work best for their particular situation.

As the elevator cab 22 moves through the hoistway or remains stationary, position information can be continuously determined by the controller 32 as needed.

In one example, one second communicating portion 42 is associated with each landing along the hoistway. Spacing the second communicating portions in this manner provides a distance of approximately 3.5 meters between the second communicating portions. This provides certain advantages such as limiting the power consumption of the ultrasonic transmitters 62. The amount of jamming among ultrasonic waves is reduced because only a few of the second communicating portions 42 are triggered at any given time. Another advantage is that time delay associated with the ultrasonic wave transmission is reduced and in one example system is less than 10 milliseconds. Moreover, a higher position update rate is achievable as the cab 22 approaches each leveling zone (i.e., landing) because the time delay (associated with the distance between the communicating portions 40 and 42) become smaller. Strategically placing the second communicating portions 42 along the hoistway allows resolution within one millimeter in a system designed according to this invention. For example, a 1/340 millisecond resolution timer, which is inexpensively commercially available, permits the inventive system to calculate the distance of wave travel and, therefore, the elevator cab position very precisely.

Significant advantages of this invention include that there is no hoistway modification or installation required. The inventive arrangement is useful for any of a variety of types of elevator systems. The wireless communication arrangement of this invention further provides better accuracy throughout the hoistway, a higher position update rate as the cab approaches a landing location and continuously provides elevator cab position information to the controller as needed.

Once the door frames 36 are installed, and all other components are operative, the cab 22 can be run through the hoistway with the controller 32 in a learning mode so that the location and identification of each second communicating portion 42 can be verified. After a single learning mode pass, the controller 32 is then capable of making as many position determinations as is required to achieve the desired elevator system operation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A system for determining a position of an elevator cab within a hoistway, comprising:

a first transceiver supported for movement with the elevator cab that generates a radio frequency trigger signal;

a second transceiver supported in a selected position relative to the hoistway, the second transceiver generating an ultrasound locating signal responsive to the trigger signal, the first transceiver receiving the locating signal; and a controller that determines a location of the cab in the hoistway based upon a characteristic of the received locating signal.

2. The system of claim 1, wherein the characteristic of the locating signal used to determine the location is a time that the locating signal travels between the second transceiver and the first transceiver.

3. The system of claim 1, wherein the first transceiver includes a transmitter portion that generates the trigger signal and an energizing signal that is received by the second transceiver, the second transceiver using the energizing signal for electrical energy for generating the locating signal.

4. The system of claim 3, wherein the trigger signal and the energizing signal comprise radio frequency signals simultaneously transmitted and one is modulated on top of the other.

5. The system of claim 1, including a plurality of second transceivers and wherein each second transceiver has a unique identifier and wherein the locating signal includes information corresponding to the identifier, the controller using the identifier information when determining the location of the cab.

6. The system of claim 5, wherein the controller learns the identification of each second transceiver during a learning pass in the hoistway.

7. An elevator system comprising:

an elevator cab that is adapted to move within a hoistway;

a plurality of door frames adapted to be supported along the hoistway;

a first wireless communicating portion supported for movement with the elevator cab, the first communicating portion including a transceiver that transmits a radio frequency triggering signal;

a plurality of second wireless communicating portions, each supported in a selected position on one of the door frames, the first and second communicating portions wirelessly transmitting signals to each other, the second communicating portion responding to the triggering signal to generate a locating signal; and a controller that utilizes information regarding the wireless communications between the communicating portions to determine the position of the elevator cab within the hoistway.

8. An elevator system, comprising:

an elevator cab that is adapted to move within a hoistway;

a first wireless communicating portion supported for movement with the elevator cab, the first communicating portion including a transceiver that transmits a radio frequency triggering signal;

a plurality of second wireless communicating portions supported in a selected positions relative to the hoistway, the first and second communicating portions wirelessly transmitting signals to each other, the second communicating portion responding to the triggering signal to generate a locating signal that comprises an ultrasound signal; and a controller that utilizes information regarding the wireless communications between the communicating portions to determine the position of the elevator cab within the hoistway.

9. The system of claim 7, wherein the first communicating portion generates a radio frequency energizing signal that is received by a power generator portion in the second communicating portion that generates electrical energy based upon the energizing signal for transmitting the locating signal.

10. The system of claim 7, wherein each second communicating portion has a unique identifier and wherein the locating signal includes information corresponding to the identifier.

11. A method of determining the location of an elevator cab within a hoistway in an elevator system having a first wireless communicating portion supported for movement with the elevator cab and at least one second wireless communicating portion at a selected position relative to the hoistway, comprising the steps of:

generating a radio frequency trigger signal using the first wireless communicating portion;

generating an ultrasound locating signal, using the second communicating portion, responsive to the trigger signal; and determining a location of the elevator cab within the hoistway based upon a characteristic of the locating signal received by the first communicating portion.

12. The method of claim 11, including associating a unique identifier with each of a plurality of the second communicating portions and including identifier information with the locating signal.

13. The method of claim 11, including generating an energizing signal using the first communicating portion and converting the energizing signal into electrical energy at the second communicating portion for generating the locating signal.

14. The system of claim 7, wherein the locating signal comprises an ultrasound signal.

* * * * *